US008371396B2

(12) United States Patent
Braden et al.

(10) Patent No.: US 8,371,396 B2
(45) Date of Patent: Feb. 12, 2013

(54) COMMUNICATION CONNECTIONS FOR WIRED DRILL PIPE JOINTS

(75) Inventors: Jason Braden, Pearland, TX (US); Jean-Charles Rinaldi, Cannes (FR)

(73) Assignee: Intelliserv, LLC, Houston, TX (US)

( * ) Notice: Subject to any disclaimer, the term of this patent is extended or adjusted under 35 U.S.C. 154(b) by 241 days.

(21) Appl. No.: 12/825,727

(22) Filed: Jun. 29, 2010

(65) Prior Publication Data

US 2010/0264650 A1 Oct. 21, 2010

Related U.S. Application Data

(63) Continuation of application No. 11/965,148, filed on Dec. 27, 2007, now abandoned.

(60) Provisional application No. 60/954,482, filed on Aug. 7, 2007.

(51) Int. Cl.
*E21B 47/16* (2006.01)

(52) U.S. Cl. ... 175/40; 166/242.6; 166/65.1; 166/250.1; 439/320; 340/854.9; 340/855.1

(58) Field of Classification Search ..... 166/242.6, 166/65.1, 250.01; 175/40; 439/320, 359
See application file for complete search history.

(56) References Cited

U.S. PATENT DOCUMENTS

| | | | | |
|---|---|---|---|---|
| 2,178,931 | A * | 11/1939 | Crites et al. | 439/191 |
| 3,518,608 | A * | 6/1970 | Papadopoulos | 439/191 |
| 4,537,457 | A * | 8/1985 | Davis et al. | 439/190 |
| 7,156,676 | B2 * | 1/2007 | Reynolds, Jr. | 439/194 |
| 2006/0108803 | A1 * | 5/2006 | Reynolds, Jr. | 285/334 |
| 2007/0167051 | A1 * | 7/2007 | Reynolds, Jr. | 439/194 |

* cited by examiner

*Primary Examiner* — Jennifer H Gay
*Assistant Examiner* — Elizabeth Gitlin
(74) *Attorney, Agent, or Firm* — Conley Rose, P.C.

(57) ABSTRACT

A drill pipe includes a pin end connector, a box end connector, a first communication connector and a second communication connector. The pin end connector includes a first region to form a threaded connection to join sections of the drill pipe together, and the first region includes at least one thread that begins at one end of the first region and ends at the other end of the first region. The box end connector receives the pin end connector, and the box end connector includes a second region to mate with the first region to form the threaded connection. The first communication connector is attached to the pin end connector and is located in the first region; and the second communication connector is attached to the box end connector and located in the second region to form a communication connection with the first communication connector.

5 Claims, 7 Drawing Sheets

COMMUNICATION CONNECTIONS FOR WIRED DRILL PIPE JOINTS

BACKGROUND

The invention generally relates to communication connections for wired drill pipe joints.

A typical system for drilling an oil or gas well includes a tubular drill pipe, also called a "drill string," and a drill bit that is located at the lower end of the drill string. During drilling, the drill bit is rotated to remove formation rock, and a drilling fluid called "mud" is circulated through the drill pipe and returns up the annulus for such purposes as cooling the drill bit and removing debris that is generated by the drilling. A surface pumping system typically generates the circulating mud flow by delivering the mud to the central passageway of the drill pipe and receiving mud from the annulus of the well. More specifically, the circulating mud flow typically propagates downhole through the central passageway of the drill pipe, exits the drill pipe at nozzles that are located near or in the drill bit and returns to the surface pumping system via the annulus between the pipe and the wellbore.

One technique to rotate the drill bit involves applying a rotational force (through a rotary table and kelly arrangement or through a motorized swivel, as examples) to the drill pipe at the surface of the well to rotate the drill hit at the bottom of the string. Another conventional technique to rotate the drill bit takes advantage of the mud flow through the drill pipe by using the flow to drive a downhole mud motor, which is located near the drill bit. The mud motor responds to the mud flow to produce a rotational force that turns the drill bit.

The drilling of the well may be aided by communication between the surface of the well and tools at the bottom of the drill pipe. In this regard, the bottom end of a conventional drill pipe may include tools that measure various downhole parameters (pressures, temperatures and formation parameters, as examples) and characteristics of the drilling (direction and inclination of the drill bit, for example), which are communicated uphole. The uphole communication from a downhole location to the surface may involve the use of a mud pulse telemetry tool to modulate the circulating mud flow so that at the surface of the well, the modulated mud flow may be decoded to extract data relating to downhole measurements. Additionally, downhole communication may be established from the surface of the well to downhole tools of the drill pipe through one of a number of different conventional telemetry techniques. This downhole communication may involve, as examples, acoustic or electromagnetic signaling.

A more recent innovation in drill pipe telemetry involves the use of a wired drill pipe (WDP) infrastructure, such as the WDP infrastructure that is described in U.S. Patent Application Publication No. US 2006/0225926 A1, entitled, "METHOD AND CONDUIT FOR TRANSMITTING SIGNALS," which published on Oct. 12, 2006 and is owned by the same assignee as the present application. The WDP infrastructure typically includes communication lines that are embedded in the housing of the drill pipe. Because a conventional drill pipe may be formed from jointed tubing sections, communication connections for the WDP infrastructure may be made at each joint of the drill string. Due to the repeated use of the jointed tubing sections in numerous drilling jobs, the drill pipe joints typically are often re-faced and re-cut. Challenges typically arise in designing the communication connections for the WDP infrastructure in order to accommodate the re-facing and re-cutting of the drill pipe joints.

SUMMARY

In one aspect, a drill pipe includes a pin end connector, a box end connector, a first communication connector and a second communication connector. The pin end connector includes a first region to form a threaded connection to join sections the drill pipe together, and the first region includes at least one thread that begins at one end of the first region and ends at the other end of the first region. The box end connector receives the pin end connector, and the box end connector includes a second region to mate with the first region to form the threaded connection. The first communication connector is attached to the pin end connector and is located in the first region; and the second communication connector is attached to the box end connector and is located in the second region to form a communication connection with the first communication connector.

In another aspect, a drill pipe includes a pin end connector, a box end connector to receive the pin end connector, a first communication connector and a second communication connector. One of the pin end and box end connectors includes a shoulder that defines a corner and is located near an end of the other of the pin end and box end connectors when the box end connector is received the pin end connector. One of the first and second communication connectors is located in a pocket that is formed in the corner.

In another aspect, a drill pipe includes a pin end connector, a box end connector to receive the pin end connector, a first communication connector and a second communication connector. The box end connector includes an inner shoulder to be in close proximity to an end of the pin end connector when the box end connector receives the pin end connector, and the first communication connector is attached to the pin end connector near the end of the pin end connector. The second communication connector is attached to the box end connector near the inner shoulder of the box end connector and is located radially outside of the first communication connector. The second communication connector is adapted to form a communication connection with the first communication connector.

In another aspect, a technique includes connecting drill pipe sections together, including threadably engaging a first region of a pin end connector with a second region of a box end connector. The technique includes communicating a signal through a communication connection that spans between the first and second regions.

In yet another aspect, a technique includes connecting drill pipe sections together, including engaging a pin end connector with a box end connector. The technique includes communicating a signal through a communication connection that spans between a first region of the pin end connector, which is located near an end of the pin end connector and a second region of the box end connector, which is located near an inner shoulder of the box end connector and radially outside of the first region.

Advantages and other features of the invention will become apparent from the following drawing, description and claims.

DETAILED DESCRIPTION

Figure 1:
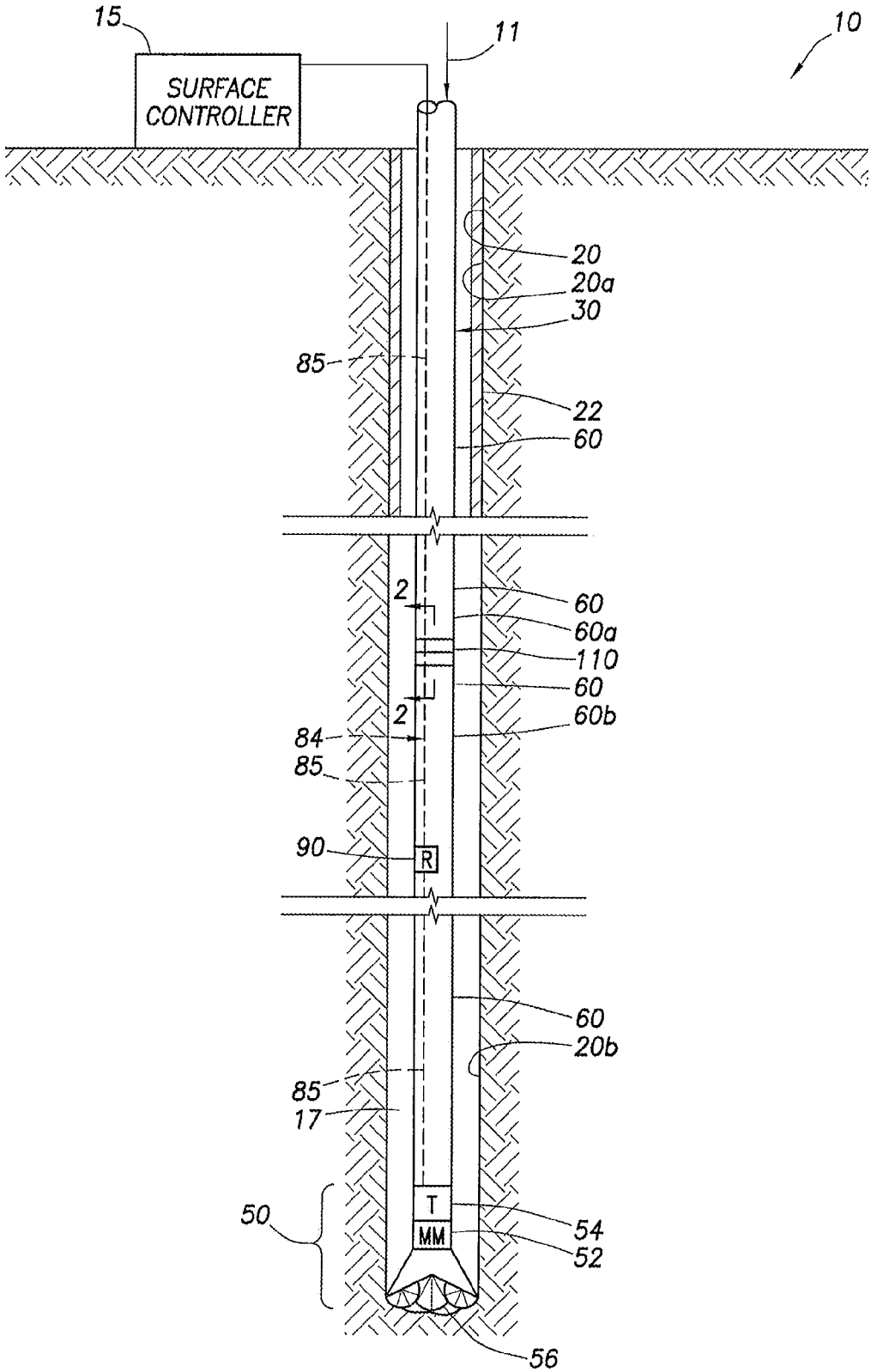
FIG. 1 is a schematic diagram of a drilling system according to an example.

According to one example, FIG. 1 schematically depicts a drilling system 10 that includes a drill string, or pipe 30. During drilling of a wellbore 20, a surface pumping system (not shown) delivers a mud flow 11 to the central passageway of the drill pipe 30, and the mud flow 11 propagates downhole through the pipe 30. Near the bottom end of the drill pipe 30, the mud flow 11 exits the pipe 30 at nozzles (not shown) and returns uphole to the surface pumping system via an annulus 17 of the well. As an example, the circulating mud flow may actuate a downhole mud motor 52 that, in turn, rotates a drill bit 56 of the drill pipe 30.

FIG. 1 depicts a particular stage of the well during its drilling and completion. In this stage, an upper segment 20*a* of the wellbore 20 has been formed through the operation of the drill pipe 30, and the wellbore segment 20*a* is lined with and supported by a casing string 22 that has been installed in the segment 20*a*. For this example, the wellbore 20 extends below the cased segment 20*a* into a lower, uncased segment 20*b*.

Thus, for the example that is depicted in FIG. 1, drilling operations may be interlaced with casing installation operations. However, the drill pipe 30 may alternatively be used as part of the well completion, in another example. In this manner, called "casing drilling," the drill pipe 30 may be constructed to line and support the wellbore 20 so that at the conclusion of the drilling operation, the drill pipe 30 is left in the well to perform the traditional function of the casing.

The drilling operation and/or the downhole formations through which the wellbore 20 extends may be monitored at the surface of the well via measurements that are acquired downhole. For this purpose, the drill pipe 30 has a wired drill pipe (WDP) infrastructure 84 for purposes of establishing one or more communication link(s) between the surface of the well and downhole tools that acquire the measurements, such as tools that are part of a bottom hole assembly (BHA) 50 of the pipe 30. A non-limiting examples, the WDP infrastructure 84 may provide electrical and/or optical communication link(s).

The communication through the WDP infrastructure 84 may be bidirectional, in that the communication may be from the surface of the well to the BHA 50 and/or from the BHA 50 to the surface of the well. Furthermore, the communication may involve the communication of power from the surface of the well to the BHA 50. Thus, many variations and uses of the WDP infrastructure 84 are contemplated and are within the scope of the appended claims.

The WDP infrastructure 84 includes communication line segments 85 (fiber optic line segments or electrical cable segments, as just a few examples) that are embedded in the housing of the drill pipe 30, and the WDP infrastructure 84 may include various repeaters 90 (one repeater 90 being depicted in FIG. 1) along the drill pipe's length to boost the communicated signals.

In general, the drill pipe 30 is formed from jointed tubing sections 60 (specific jointed tubing sections 60*a* and 60*b* being labeled in FIG. 1 and described herein as examples) that are joined together at WDP joints 110 (one WDP joint 110 between the jointed tubing sections 60*a* and 60*b* being depicted in FIG. 1 as an example). As an example, each WDP joint 110 may be part of a drill pipe connection sub.

A given jointed tubing section 60 may have one or more communication line segments 85, possibly one or more repeaters 90 and communication connectors (not shown in FIG. 1) on either end of each communication line segment 85. As described below, the communication connectors are disposed in the WDP joints 110 for purposes of connecting the communication line segments 85 of different jointed tubing sections 60 together. Pursuant to the WDP infrastructure, the drill pipe 30 may contain multiple communication lines that extend between the surface and downhole, with each communication line being formed from serially connected communication line segments 85, repeaters 90 and WDP joint communication connectors.

Among the other features of the drill pipe 30, the BHA 50 may include a communication tool 54 that communicates with a surface controller 15 via signals that are communicated over the WDP infrastructure 84. As examples, the tool 54 may receive power, control and/or data signals from the WDP infrastructure 84. Furthermore, the tool 54 may transmit signals (signals indicative of acquired measurements, for example) uphole to the surface controller 15 via the WDP infrastructure 84.

The tool 54 may be constructed to acquire downhole measurements, and in addition to using the WDP infrastructure 84, the tool 54 may use alternative paths (such as mud pulse telemetry, for example) for communicating with the surface. As non-limiting examples, the tool 54 may be a measurement while drilling (MWD) tool, a logging while drilling (LWD) tool, a formation tester, an acoustic-based imager, a resistivity tool, etc. Furthermore, the drill pipe 30 may contain a plurality of such tools that communicate with the surface via the WDP infrastructure 84. It is noted that the drill pipe 30 may include various other features, such as a drill collars, an under-reamer, etc., as the depiction of the drill pipe 30 in FIG. 1 is simplified for purposes of illustrating certain aspects of the pipe 30 related to the WDP infrastructure 84 and the WDP joints 110.

Figure 2:
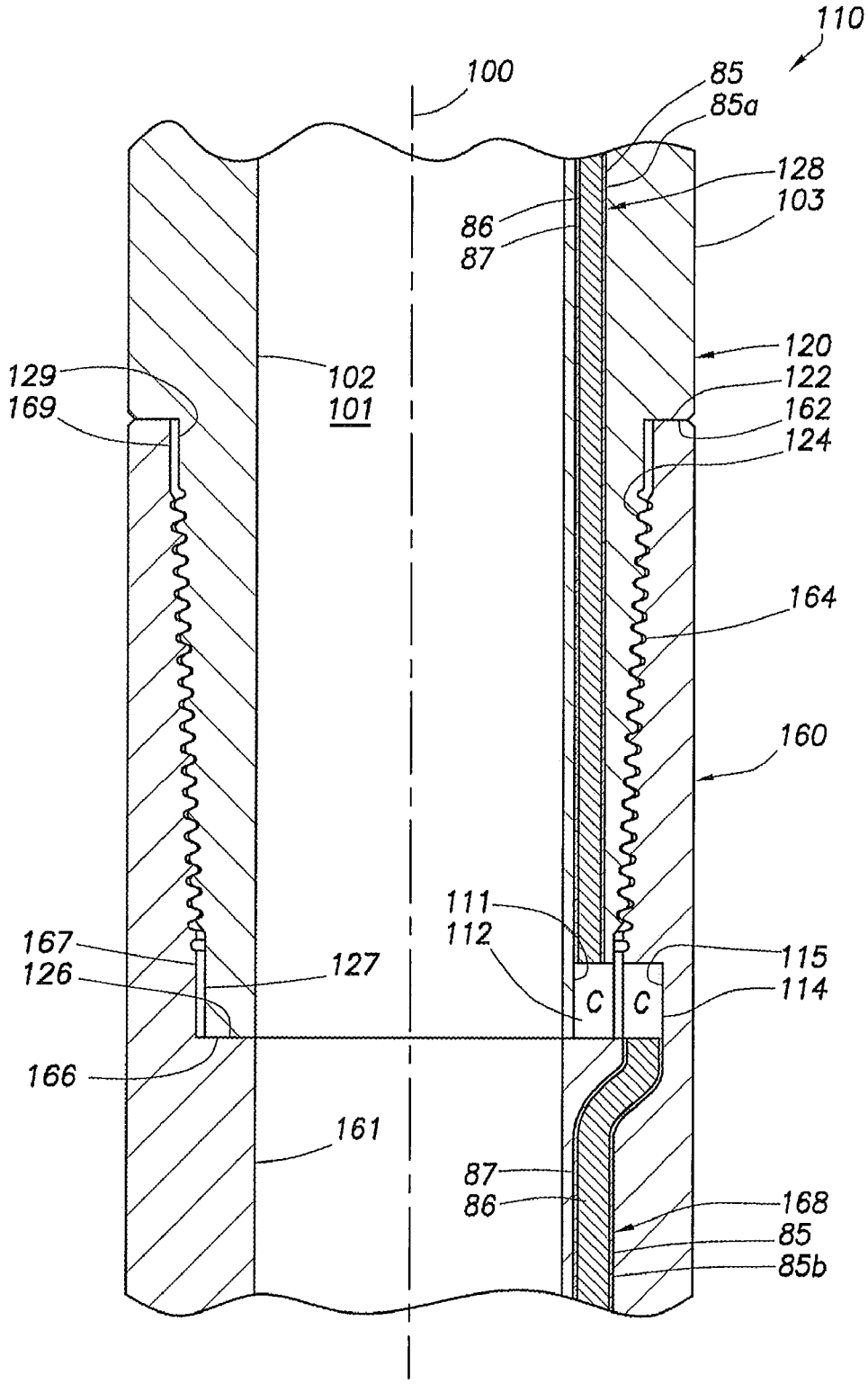
FIG. 2 is a cross-sectional view of a wired drill pipe joint taken along line 2-2 of FIG. 1 according to an example.

FIG. 2 depicts a cross-sectional view of the WDP joint 110 when fully assembled. Referring to FIG. 2 in conjunction with FIG. 1, in general, the WDP joint 110 includes two main components for purposes of mechanically connecting the upper jointed tubing section 60*a* to the lower jointed tubing section 60*b*: a pin end connector 120 and a box end connector 160. Before the pin end 120 and box end 160 connectors are mated together, the pin end connector 120 is secured to (threaded to, for example) the lower end of the upper jointed tubing section 60*a*, and the box end connector 160 is secured to (threaded to, for example) the upper end of the lower jointed tubing section 60*b*, in connections that are not depicted. In general, the pin end 120 and box end 160 connectors are concentric about a longitudinal axis 100, which is coaxial with the drill pipe 30 near the WDP joint 110. Additionally, the pin end 120 and box end 160 connectors have respective central passageways that concentrically align to form a corresponding section 101 of a central passageway of the drill pipe 30 when the WDP joint 110 is fully assembled.

As a more specific example, the WDP joint 110 may be a double shoulder, rotary connection, in that the upper jointed tubing section 60*a* and the attached pin end connector 120 are rotated about the longitudinal axis 100 with respect to the box end connector 160 and the attached lower jointed, tubing section 60*b* fix purposes of threadably connecting the pin end 120 and box end 160 connectors together. In this regard, for this example, the pin end connector 120 has an external tapered thread 124 that helically circumscribes the longitudinal axis 100 and is constructed to engage a mating, internal tapered thread 164 (of the box end connector 160), which also helically circumscribes the longitudinal axis 100.

When the WDP joint 110 is fully assembled, a downwardly directed annular face 126 of the pin end connector 120 contacts or at least conies in close proximity to an upwardly directed, inner annular shoulder 166 (herein called the "internal shoulder 166") of the box end connector 160. Also, when the WDP joint 110 is fully assembled, an upwardly directed annular face 162 of the box end connector 160 contacts or at least comes in close proximity to a downwardly facing external annular shoulder 122 (herein called the "external shoulder 122") of the pin end connector 120.

The external thread 124 of the pins end connector 120 longitudinally and continuously (as one example) extends between two relatively smooth external cylindrical surfaces 127 and 129 of the connector 120. More specifically, the external thread 124 longitudinally extends from the external surface 129, which is located near the external shoulder 122 to the external surface 127, which is located near the lower end of the pin end connector 120. The internal thread 164 of the box end connector 160 longitudinally and continuously (as one example) extends between two relatively smooth internal cylindrical surfaces 167 and 169 of the connector 160. More specifically, the internal thread 164 extends from the internal surface 169, which is located near upper end of the box end connector 160 to the internal surface 167, which is located near the internal shoulder 166 of the box end connector 160.

As depicted in FIG. 2, when the WDP joint 110 is fully assembled, the internal surface 169 of the box end connector 160 is adjacent to and located radially outside of the external surface 129 of the pin end connector 120. Also, for the fully assembled WIN joint 110, the internal surface 167 of the box end connector 160 is adjacent to and located radially outside of the external surface 127 of the pin end connector 120.

In accordance with examples that are described herein, communication connectors are disposed in the pin end 120 and box end 160 connectors for purposes of establishing one or more communication connections (for the WDP infrastructure 84), which span across the WDP joint 110.

As a more specific example, FIG. 2 depicts communication connectors 112 and 114, which connect respective communication line segments in the jointed tubing sections 60*a* and 60*b* together. For this example, the communication connectors 112 and 114 are arranged to establish a communication connection that spans between the surfaces 127 and 167. The communication connector 112 is disposed in a pocket 111 of the pin end connector 120 near the bottom end of the connector 120 and is generally oriented to form a connection at the outer surface 127. The communication connector 114 is disposed in a pocket 115 of the box end connector 160, located near the inner shoulder 166 and is oriented to form a connection at the surface 167. Thus, when the WDP joint 110 is fully assembled, the communication connectors 112 and 114 are in proximity to each other, with the connector 114 being located radially outside of the connector 112; and in these positions, the connectors 112 and 114 form a communication connection that spans across the WDP joint 110.

As examples, the communication connectors 112 and 114 may be constructed to communicate any of a number of different signals across the communication connection, such as electrical signals, optical signals and electromagnetic flux signals, as just a few examples. Thus, the connectors 112 and 114 may be, as examples, direct contact electrical connectors, inductive connectors, resistive couplers, toroid-typo connectors, fiber optic connectors, etc. Additionally, the communication connection that is established by the connectors 112 and 114 may be a connection to communicate a data signal, a power signal and/or a control signal.

Although one pair of connectors 112 and 114 is depicted in FIG. 2, it is understood that the WDP joint 110 may have additional sets of connector pairs for purposes of forming additional communication connections across the WDP joint 110. Thus, many variations are contemplated and are within the scope of the appended claims.

As depicted in FIG. 2, the communication connectors 112 and 114 may be connected to communication line segments 85*a* and 85*b* (specific examples of the communication line segments 85), respectively, of the WDP infrastructure 84. For this example, the communication line segments 85*a* and 85*b* are electrical wire segments, where each segment 85*a*, 85*b* is formed from an inner conductor 86 that is surrounded by an outer insulative, or dielectric, layer 87. However, it is understood that the communication line segments 85 of the WDP infrastructure 84 may be formed from other types of communication lines, such as fiber optic segments, in accordance with other examples. Thus, many variations are contemplated and are within the scope of the appended claims.

The communication line segment 85*a* extends longitudinally upwardly from the communication connector 112 and is routed through a longitudinal passageway 128 that is formed in the pin end connector 120. For this example, the passageway 128 is located near the pin end connector's inner cylindrical surface 102 that forms part of the central passageway section 101 of the drill pipe 30. However, the passageway 128 may be located closer to an outer surface 103 of the pin end connector 120, as another example. As examples, the passageway 128 may be formed by gun drilling, drilling, electrical discharge machining (EDM) or any other material removal process that forms a hole, whether the cross-section of the hole is round or otherwise. As another example, the passageway 128 may be formed using plunge EDM and cut into almost any shape desired for the cross-section of the passageway 128. The cross-section may be, as examples, round or as another example, oval to reduce stress concentrations.

The box end connector 160 includes a longitudinal passageway 168 through which the communication line, segment 85*b* is run to form a connection to the communication connector 114. The passageway 168 may be formed by any of the techniques described above and may have one of a variety of different cross-sectional shapes. As shown, the passageway 168 generally extends downhole from the communication connector 114 and may (as an example) be close to the box end connector's 160 inner surface 161 that forms part of the central passageway section 101 of the drill pipe 30.

As an example, the connectors 112 and 114 may be relatively shallow and long. The connectors 112 and 114 may be "snap and groove" connectors, in that one of the connectors 112 and 114 snaps into a groove of the other connector 112, 114. As another example, the connectors 112 and 114 may be designed so that one connector 112, 114 forms a groove into which the other connector 112, 114 slides into. As an example, protective caps may be used to protect the connectors 112 and 114 during stabbing of the pin end connector 120 into the box end connector 160. It is noted that the positioning of the communication connectors 112 and 114 permits re-cuts while maintaining the connection-to-assembly-to-hole alignment.

Figure 3:
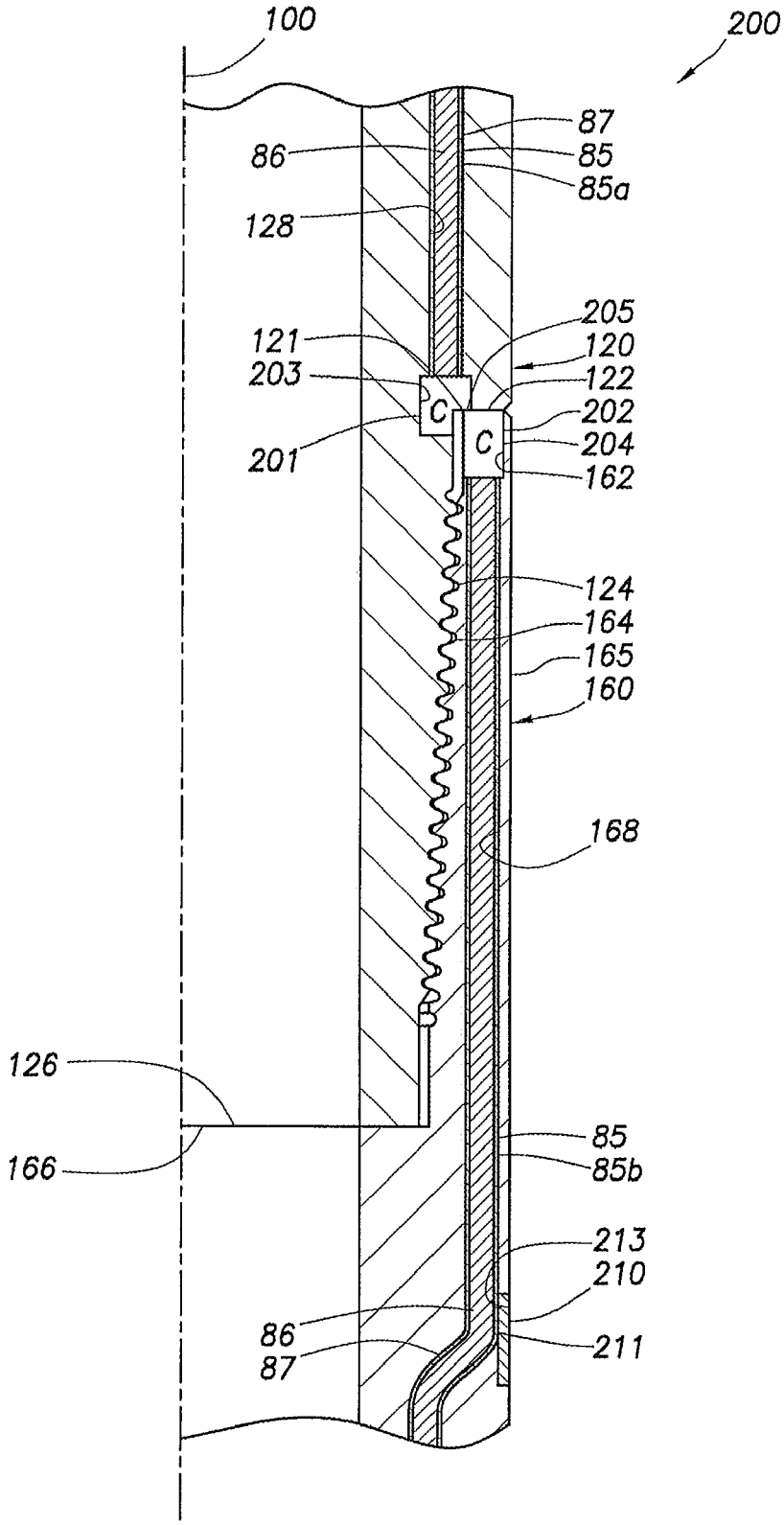
FIGS. 3, 4, 7 and 8 are partial cross-sectional views of other wired drill pipe joints according to other examples.
Figure 4:
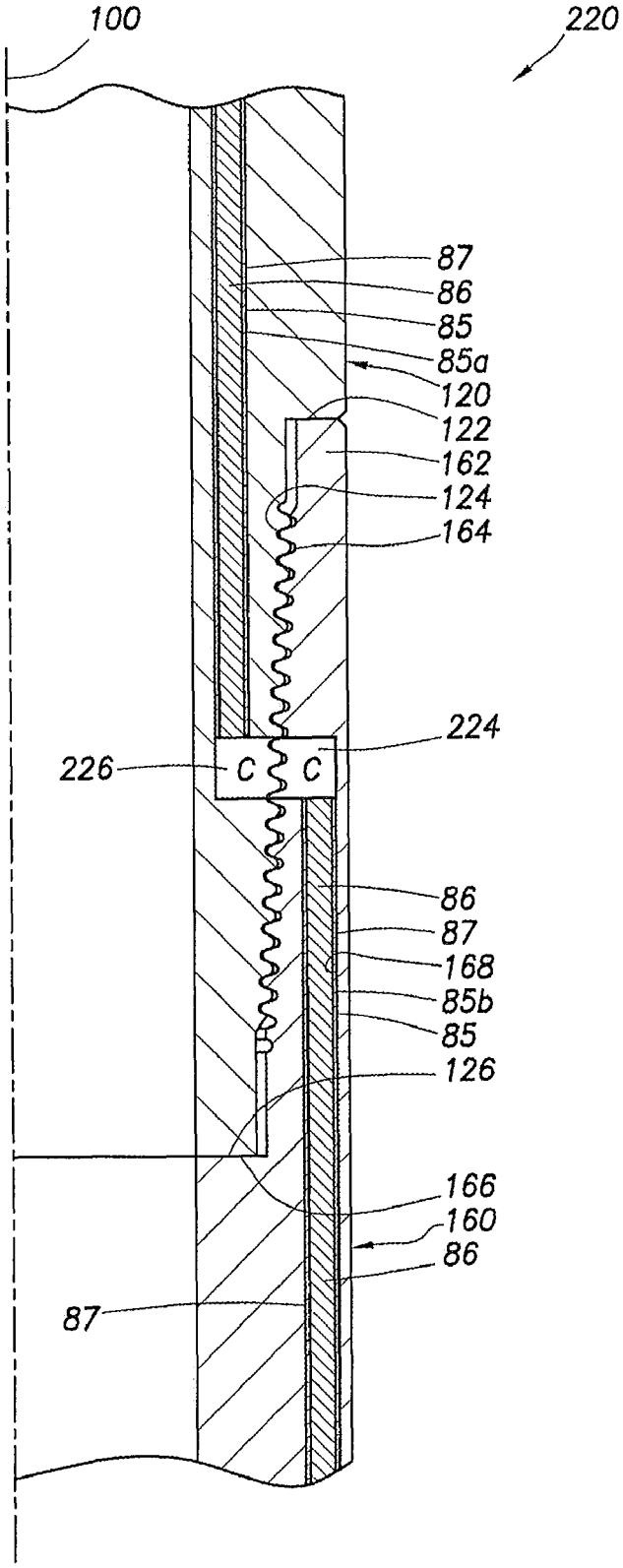
Figure 7:
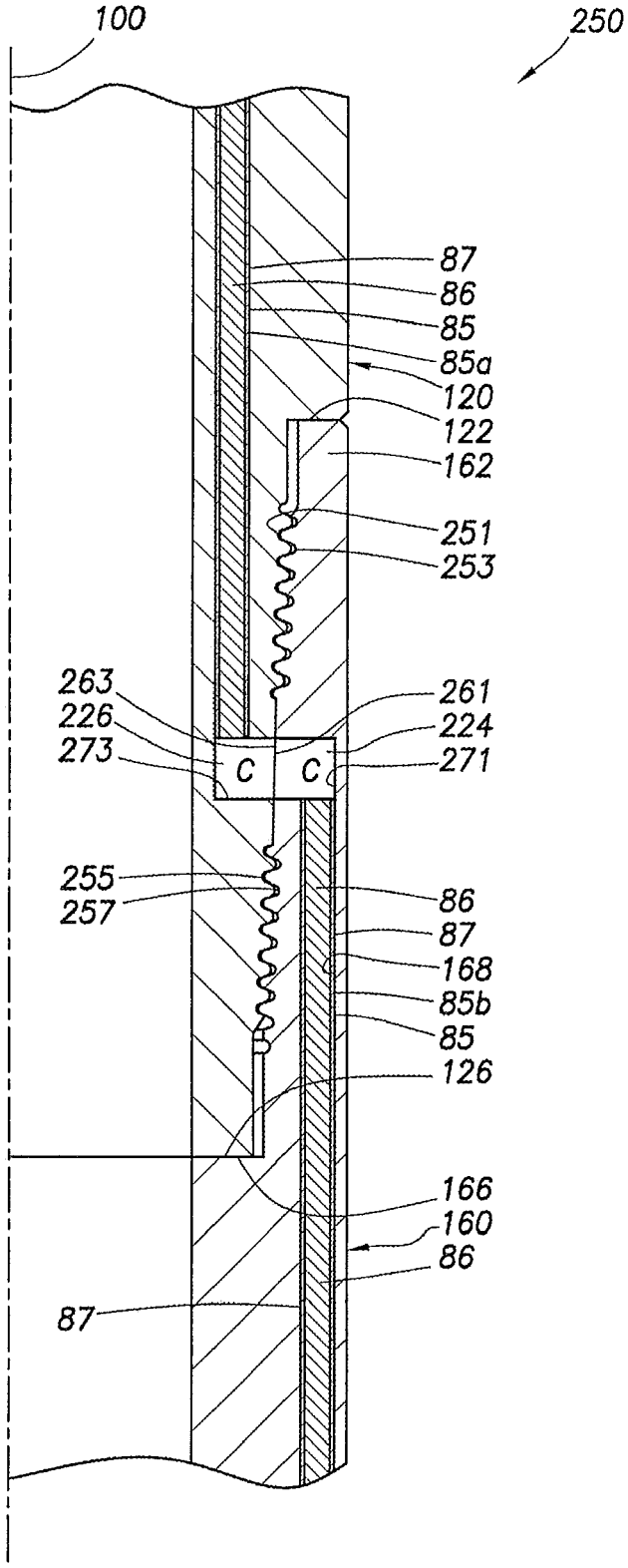
Figure 8:
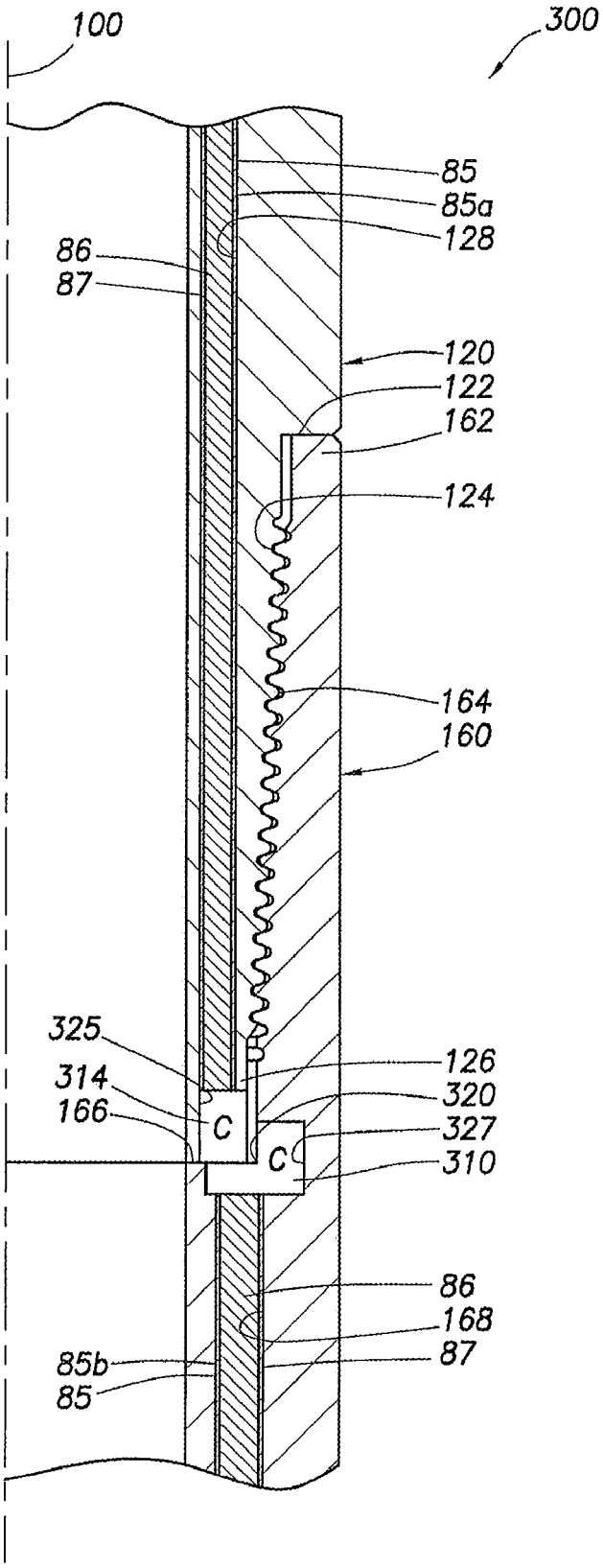

Referring to FIG. 3, as another example, the WDP joint 110 may be replaced with a WDP joint 200. Although FIG. 3, along with FIGS. 4, 7 and 8, depicts only the right hand portion (and not the left hand portion) of a WDP joint, it is understood that the pin end 120 and box end 160 connectors of each WDP joint is generally symmetrical about the longitudinal axis 100 and thus, the cross-section may be assumed to include the omitted left hand cross-sectional portion. Features of the WDP joint 200 that are similar to the WDP joint 110 are denoted by similar reference numerals.

The WDP joint 200 includes communication connectors 201 and 202 that are disposed in pockets 203 (in the pin end connector 120) and 204 (in the box end connector 160), respectively. In general, the communication connectors 201 and 202 may be connectors similar to any of the examples given above for the communication connectors 112 and 114. The pocket 203 is formed in a corner 121 that is defined by the external shoulder 122 of the pin end connector 120. Thus, for this arrangement, a portion of the corner 121 is removed, or hollowed out, to form the pocket 203. The connector 201 has a shape that preserves the corner 121 so that when the WDP joint 200 is fully assembled, the connector 202 (which is located in the upper end of the box end connector 160) fits against a portion 205 of the corner 201 that is framed by the connector 201, as shown in FIG. 3.

As also depicted in FIG. 3, respective communication segments 85*a* and 85*b* (wire segments for this example) extend away from the connectors 201 and 202, respectively. Because the communication line segment 85*b* is located near an outer surface 165 of the box end connector 160, however, (as depicted in FIG. 3) at a point 211, the communication line segment 85 begins extending inwardly toward the inside of the box end connector 160. For purposes of machining the corresponding passageway 168 to have this inclined characteristic, an external access port 213 may be created near the point, and the port 213 may be plugged via a plug 210 after the installation, of the communication line segment 85*b* in the passageway 168.

A particular advantage of the WDP joint 200 is that the communication connector 201 is protected from being damaged during handling and mating of the pin end 120 and box end 160 connectors. Also, the connectors 201 and 202 are relatively easily accessed.

Referring to FIG. 4, as another example, a WDP joint 220 (a right hand portion of which is depicted in FIG. 4) may be used in place of the other WDP joints that are described herein. The WDP joint 220 has similar features to the WDP joints 110 and 200, with like reference numerals being used to denote similar components. Furthermore, communication connectors 224 and 226 may, in general, have designs similar to any of the examples given above for the communication connectors 112 and 114. Unlike the WDP joints 110 and 200, the communication connectors 224 and 226 form a communication connection that spans across the threaded region of the joint 220. Thus, as depicted in FIG. 4, the communication connector 226 is located in the threaded region of the pin end connector 120 and is oriented to form a connection at the external thread 124; and the communication connector 224 is located radially outside of the connector 226 in the threaded region of the box end connector 160 and is oriented to form the communication at the internal thread 164.

Figure 5:
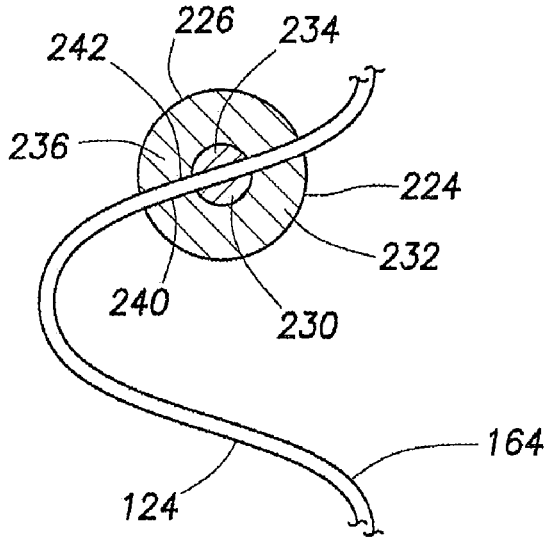
FIG. 5 is a schematic diagram illustrating a communication connection that spans across two thread flanks of a wired drill pipe joint according to an example.

As examples, the communication connectors 224 and 226 may form the communication connection that spans between the flanks of two engaging threads or may form the communication connection that spans between the root and crest of two engaging threads. More specifically, FIG. 5 depicts a non-limiting example in which the communication connectors 224 and 226 are electrical, direct contact-type connectors. For this example, the communication connector 224 includes an electrically conductive material 230 that is exposed on a flank 240 of the thread 164 and is disposed in an electrically insulative, or dielectric, well 232 of the connector 224.

When the WDP joint 220 (see also FIG. 4) is assembled, the electrically conductive material 230 of the communication connector 224 contacts an electrically conductive material 234 of the communication connector 226. Similar to the communication connector 224, electrically conductive material 234 of the connector 226 resides inside a dielectric well 236 of the connector 226. For purposes of making the contact, the electrically conductive material 234 is exposed on a flank 242 of the thread 124 of the pin end connector 120.

Figure 6:
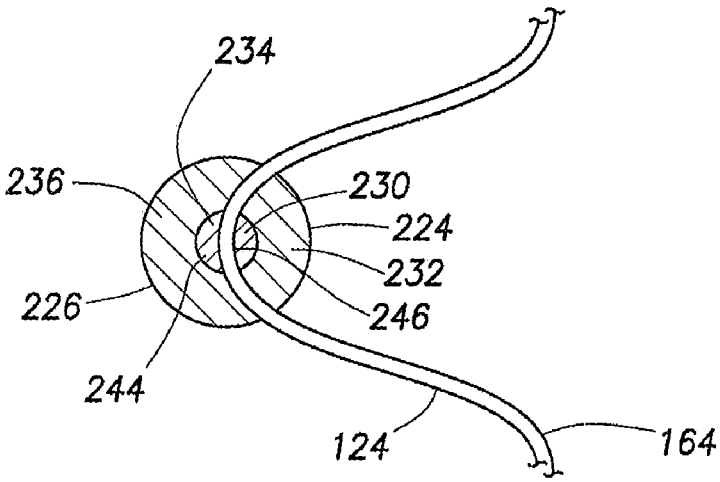
FIG. 6 is a schematic diagram illustrating a communication connection that spans across the root of one thread of a wired drill pipe joint and the crest of thread of the joint according to an example.

As an alternative, the above-described direct contact communication connectors may be used to establish a communication connection that spans between the root and crest of two engaging threads. Referring to FIG. 6, as an example, the communication connector 224 may be situated in the thread 164 such that the electrically conductive material 230 is exposed at a crest 246 of the thread 164; and the communication connector 226 may be situated such that the electrically conductive material 234 is exposed at a root 244 of the thread 124 for purposes of establishing connection between the electrically conductive regions 224 and 236 when the WDP joint 220 is assembled.

It is noted that for purposes of FIGS. 5 and 6, the disclosure of a direct contact-type connector is merely provided as an example of one out of many possible types of connectors that may be used. Other variations are contemplated (such as fiber optic or inductive coupling-based connectors, as non-limiting examples) and are within the scope of the appended claims.

Referring back to FIG. 4, a particular advantage of placing a connection in the threaded region of the WDP joint 220, such as the middle of the threaded region (as the example depicted in FIG. 4) is generally that the stress levels in the middle of the threaded region, is generally lower than at the ends, i.e., the stress may be higher at the last engaged threads (LETs). It is noted that the connectors 224 and 226 may alternatively be disposed in the upper or lower portions of the threaded region.

Although the communication connectors 224 and 226 may be, in general, located in the threaded region of the pin end 120 and box end 160 connectors for purposes of forming a communication connection in the region, the communication connectors 224 and 226 may create a communication connection that does not directly span between two threads. For example, FIG. 7 depicts a WDP joint 250 (the right hand side of the joint being depicted in FIG. 7) that is similar in design to the WDP joint 220 (see. FIG. 4), with similar reference numerals being used to denote similar components. However, unlike the WDP joint 220, the threaded region between the pin end 120 and box end 160 connectors is not formed from a contiguous region of engaged threads.

Instead, the threaded region between the pin end 120 and box end 160 connectors includes, near its upper end, a first threaded region in which an interior thread 253 of the pin end connector 120 engages a corresponding exterior thread 251 of the box end connector 160. Near the lower end of the WDP joint 250, the threaded region includes an internal tapered thread 257 of the box end connector 160, which engages a corresponding external thread 255 of the pin end connector 120.

The threaded region also includes an intervening non-threaded region. In particular, the pin end connector 120 includes a relatively smooth and tapered external surface 263 that extends between the upper external thread 251 and the lower external thread 255. Similarly, the box end connector 160 includes a mating relatively smooth and tapered internal surface 263 that extends between the upper 253 and lower 257 internal threads of the connector 160. In general, when the WDP joint 250 is fully assembled, the surfaces 261 and 263 are opposed to and in close proximity to each other. As depicted in FIG. 7, the communication connectors 224 and 226 are disposed in pockets 271 (in the box end connector 160) and 273 (in the pin end connector 120), respectively. The communication connectors 224 and 226 are oriented to form a communication connection that spans across the surfaces 261 and 263.

Other variations are contemplated and are within the scope of the appended claims. For example, FIG. 8 depicts a WDP joint 300 that is a variation of the WDP joint 200 of FIG. 3. Similar reference numerals are used to denote similar components. Furthermore, communication connectors 314 and 327 may, in general, have designs similar to any of the connector examples that are delivered herein. Instead of establishing the communication connection at the corner 121 (as depicted in FIG. 3) that is defined by the external shoulder 122, a communication connection may be established at a corner 320 that is defined by the internal shoulder 166. In the WDP joint 300, a pocket 325 is formed in the corner 320 to accept the communication connector 314, which is shaped to preserve the corner 320. A corresponding communication connector 310 is disposed in a pocket 327 of the pin end connector 120 and is located near its lower end such that when the WDP joint 300 is fully assembled, the communication connector 310 resides in the corner created by the communication connector 314, as depicted in FIG. 8.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A drill pipe having a longitudinal axis, comprising:

a pin end connector including an end face defining a radially inner shoulder, a radially outer shoulder axially spaced apart from the end face of the pin end connector, and a radially outer surface extending axially from the end face of the pin end connector to the radially outer shoulder of the pin end connector;

wherein the radially outer surface of the pin end connector includes an external thread extending axially from a first thread end proximal the end face of the pin end connector and a second thread end distal the end face of the pin end connector;

a box end connector that coaxially disposed about the pin end connector, the box end connector including an end face defining a radially outer shoulder axially adjacent the radially inner shoulder of the pin end connector, a radially inner shoulder axially spaced apart from the end face of the box end connector and axially adjacent the end face of the pin end connector, and a radially inner surface extending axially from the end face of the box end connector to the radially inner shoulder of the box end connector;

wherein the radially inner surface of the box end connector includes an internal thread extending axially from a first thread end proximal the end face of the box end connector to a second thread end distal the end face of the box end connector, and wherein the internal thread of the box end connector threadingly engages the external thread of the pin end;

a first communication connector attached to the pin end connector, wherein the first communication connector is disposed along the radially outer surface of the pin end connector and axially positioned between the first thread end and the second thread end of the external thread of the pin end connector, wherein the first communication connector forms at least a portion of the external thread of the pin end connector, and wherein the first communication connector is completely disposed along a flank extending from a crest to a root of the external thread; and a second communication connector attached to the box end connector and adapted to form a communication connection with the first communication connector, wherein the second communication connector is disposed along the radially inner surface of the box end connector and axially positioned between the first thread end and the second thread end of the internal thread of the box end connector, wherein the second communication connector forms at least a portion of the internal thread of the box end connector, wherein the second communication connector is completely disposed along a flank extending from a crest to a root of the internal thread and is opposite the flank of the external thread of the pin end connector.

2. The drill pipe of claim 1, wherein the communication connection extends radially between the external thread of the pin end connector and the internal thread of the box end connector.

3. The drill pipe of claim 1, wherein the first communication connector comprises an electrically conductive material disposed in a dielectric well;

wherein the second communication connector comprises an electrically conductive material disposed in a dielectric well; and wherein the conductive material of the first communication connector engages the conductive material of the second communication connector.

4. A drill pipe having a longitudinal axis, comprising:

a pin end connector including an end face, a radially outer shoulder axially spaced apart from the end face of the pin end connector, a radially outer surface extending axially between the end face of the pin end connector and the radially outer shoulder of the pin end connector, and a first communication connector forming at least a portion of the radially outer surface;

wherein the radially outer surface of the pin end connector includes a first threaded region proximal the end face end face of the pin end connector and a second threaded region distal the end face of the pin end connector, and wherein the first communication connector is axially positioned between the first threaded region and the second threaded region of the radially outer surface;

a box end connector coaxially disposed about the pin end connector, the box end connector including an end face axially opposed the radially inner shoulder of the pin end connector, a radially inner shoulder axially opposed the end face of the pin end connector, a radially inner surface extending between the end face of the box end connector and the radially inner shoulder of the box end connector, and a second communication connector forming at least a portion of the radially inner surface;

wherein the radially inner surface of the box end connector includes a first threaded region proximal the end face of the box end connector and a second threaded region distal the end face of the box end connector, and wherein the second communication connector is axially positioned between the first threaded region and the second threaded region of the radially inner surface; and wherein the first threaded region of the radially inner surface is radially adjacent the second threaded region of the radially outer surface and the second threaded region of the radially inner surface is radially adjacent the first threaded region of the radially outer surface, and wherein the first communication connector is radially adjacent the second communication connector;

wherein the first communication connector forms a portion of a flank of an external thread on the first threaded region of the radially outer surface of the pin end, and wherein the first communication connector is completely disposed between a root of the external thread immediately adjacent the flank of the external thread and a crest of the external thread immediately adjacent the flank of the external thread;

wherein the second communication connector forms a portion of a flank of an internal thread on the first threaded region of the radially inner surface of the box end, and wherein the second communication connector is completely disposed between a root of the internal thread immediately adjacent the flank of the internal thread and a crest of the internal thread immediately adjacent the flank of the internal thread.

5. The drill pipe of claim 4, wherein the external thread extends axially through the first threaded region and the second threaded region of the radially outer surface; and wherein the internal thread extends axially through the first threaded region and the second threaded region of the radially inner surface.

* * * * *